United States Patent [19]

Sakaki et al.

[11] Patent Number: 4,885,901

[45] Date of Patent: Dec. 12, 1989

[54] BAND LOADING APPARATUS IN A PACKAGING MACHINE

[75] Inventors: Yasunori Sakaki, Tokyo; Tsutomu Tagomori, Yokohama, both of Japan

[73] Assignee: Strapack Corporation, Tokyo, Japan

[21] Appl. No.: 247,356

[22] Filed: Sep. 21, 1988

Related U.S. Application Data

[62] Division of Ser. No. 127,290, Dec. 1, 1987, Pat. No. 4,845,928.

[30] Foreign Application Priority Data

Jul. 8, 1987 [JP] Japan ..... 62-103876

[51] Int. Cl.[4] ..... B65B 13/04

[52] U.S. Cl. ..... 53/589; 53/583; 53/389

[58] Field of Search ..... 53/580, 589, 582, 390, 53/389; 100/33 PB

[56] References Cited

U.S. PATENT DOCUMENTS

| | | | |
|---|---|---|---|
| 3,447,447 | 6/1969 | Rutty | 100/33 PB |
| 4,155,799 | 5/1979 | Matsushita | 53/589 X |
| 4,177,724 | 12/1979 | Johnson | 53/589 X |
| 4,271,655 | 6/1981 | Nagayoshi | 53/589 |
| 4,383,881 | 5/1983 | Sakaki | 53/589 X |
| 4,559,767 | 12/1985 | Takami | 53/589 X |
| 4,605,178 | 8/1986 | Bartzick et al. | 53/589 X |

FOREIGN PATENT DOCUMENTS

| | | | |
|---|---|---|---|
| 60-92904 | 6/1985 | Japan . | |
| 950006 | 2/1964 | United Kingdom | 53/589 |

*Primary Examiner*—John Sipos

*Attorney, Agent, or Firm*—Burns, Doane, Swecker & Mathis

[57] ABSTRACT

A strapping machine includes a pair of motor-driven feed rollers for feeding a band from a pool box and into encompassing relation to an object to be strapped. A pre-feeding roller pair is disposed between the pool box and the feed rollers for pre-feeding the band to the feed rollers. The pre-feeding roller pair is normally in a rest position which permits the band to travel therepast. When manually rotated, the prefeeding roller pair positively advances the band to deliver a leading end thereof to the feed rollers. A sensor detects rotation of the pre-feeding roller pair to energize the feed rollers for a predetermined time period to advance the band.

6 Claims, 9 Drawing Sheets

FIG. 5
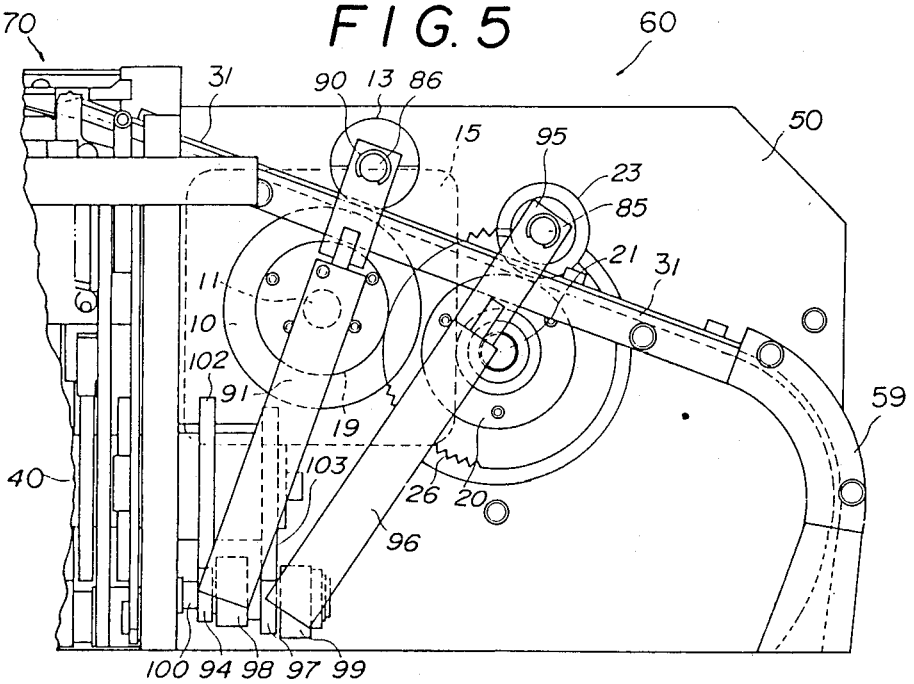
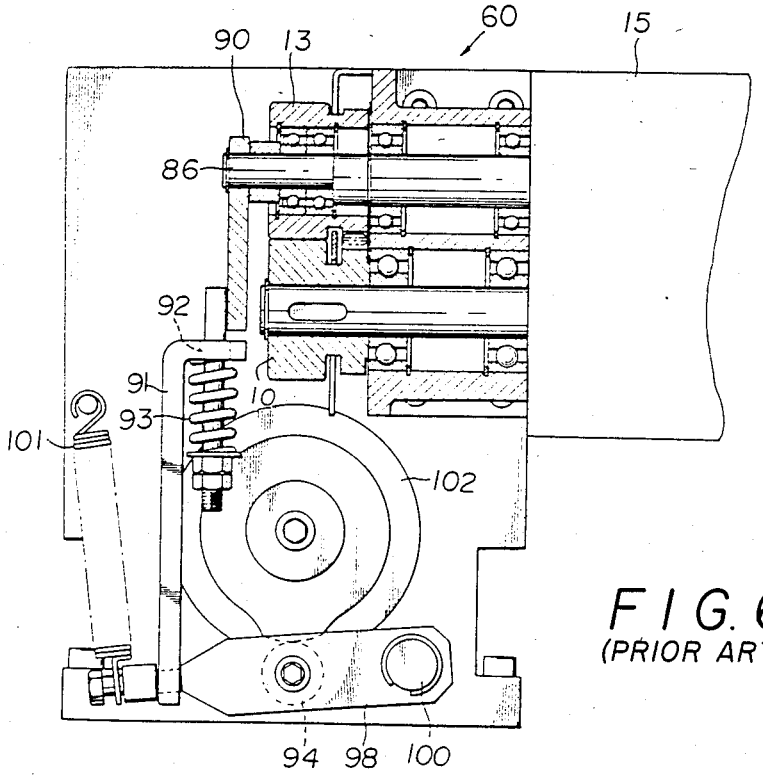
FIG. 6
(PRIOR ART)

BAND LOADING APPARATUS IN A PACKAGING MACHINE

This application is a divisional of application Ser. No. 07/127,290, filed Dec. 1, 1987, now Pat. No. 4,845,928 granted July 11, 1989.

The present invention relates to a band-loading apparatus in a packaging machine said apparatus being disposed between a pair of feed rollers for feeding a band to the band guide arch of the packaging machine and a pool box provided with a pool feed roller for removing the band from a band coil, whereby the band is fed to the band guide arch through the feed rollers prior to use of the packaging machine to set the band, and resetting of the band can easily be performed in the event of the failure of the end of the band to issue from the feed rollers caused by inertia due to the reverse-rotation thereof when the end of the band is not gripped during the pulling back and tightening process of the band.

BACKGROUND OF THE INVENTION

An automatic packaging machine, which is commonly provided with a band guide arch for arranging a band in a looping manner around goods to be packaged, requires feeding the band as rapidly as possible for improving the packaging efficiency. A packaging machine of this type is provided with a pool box 30 for pooling or accumulating therein the band fed to the arch, because a band coil loaded with a large amount of the band is very heavy, and because it is difficult to remove the band from a band reel loaded with the band coil through a pair of feed rollers and then to feed the band to the arch directly.

The automatic packaging machine provided with the pool box is required to grasp the band removed from the band reel, prior to the packaging operation, between a pair of band-feeding feed rollers. The rollers feed the band through the pool box, a band-tightening mechanism and other instruments and, simultaneously, pre-pool the band in the pool box for facilitating to eventual feeding of the band to the arch and various means for performing such a series of operations have hereto been proposed.

DESCRIPTION OF THE PRIOR ART

Conventionally employed band-loading apparatuses of this type are exemplified, as disclosed in Japanese Laid-Open Utility Model application No. 92,904/1985, by a band-loading apparatus for a packaging machine provided with band-tightening equipment composed of a feed roller 7, as illustrated in FIGS. 10(A) and 10(B). The band-loading apparatus includes a pool box 4 having a band inlet 4*a* and a band outlet 4*b*; a pool roller 5 for feeding a band to the band inlet 4*a*; and a band guide plate 8 defining a band guide passage 6, from the band inlet 4*a* to the band outlet 4*b*. The feed roller 7 is utilized for feeding a band 1 from the band outlet 4*b* to a vertically upstanding band guide arch and for returning and tightening the band from the band guide arch. The base 8*a* of the guide plate 8 is pivotably attached to one side wall 3 of the pool box 4 whereby the end 8*b* thereof is capable of extending down at a position in parallel with one side wall 3 and rising to a position in parallel with the rear wall 9 of the pool box 4.

The conventional machine illustrated in FIGS. 10A, 10B can achieve the purpose of initially loading the band by feeding the band from the pool roller 5 at a speed of rotation thereof equal to or greater than that of the feed roller 7. The band is fed through the guide passage 6 to the feed rollers 7 and thence around the band guide arch (denoted by a numeral 81 in FIGS. 3 and 4). When the band concludes its travel around the arch, the guide plate 8 is rotated downwardly to permit the band to pool within the pool box. In this case, the pool roller 5 which causes a very heavy band coil to rotate for removing the band 1, requires high torque, thus resulting in a low roller speed. Accordingly, in order that the speed of rotation of both rollers be made identical, the speed of rotation of the feed roller 7 must be made so low as to considerably sacrifice of packaging efficiency.

The apparatus described above, which lacks a means for detecting completion of the loading of the band, presented a problem in that delayed downward rotation of the band guide plate caused a jam of the band 1 on the band passage, with a resultant difficulty in pulling-back and subsequent feeding of the band.

OBJECT OF THE PRESENT INVENTION

It is an object of the present invention for solving the problems in the conventional example described above to provide a band-feeding apparatus in a packaging machine wherein there is provided a simplified band pooling mechanism which promotes easy loading of the band at the initial stage of the use of the packaging machine and in the event of exchange of a band coil. Smooth loading of the band should be effected even when a narrow, soft and flexible band is used. The band should easily be supplied to a mechanism for feeding and retightening of the band when the band comes off from the mechanism; whereby efficiency of the packaging operation is improved.

BRIEF DESCRIPTION OF THE DRAWINGS

FIG. 5, a front view of a mechanism for feeding and tightening the band;

FIG. 6, a sectional view of a rotating roller in FIG. 5;

FIGS. 7 and 8, a still further embodiment of the present invention;

FIG. 7, a main portion front view;

FIG. 8, an enlarged view of a band set unit, in which

FIGS. 10(A) and 10(B), a conventional technique, in which FIG. 10(A) is a side view of a pool box from which another side wall is removed, and FIG. 10(B) is a sectional view thereof.

DETAILED DESCRIPTION OF THE PREFERRED EMBODIMENTS

Figure 4A:
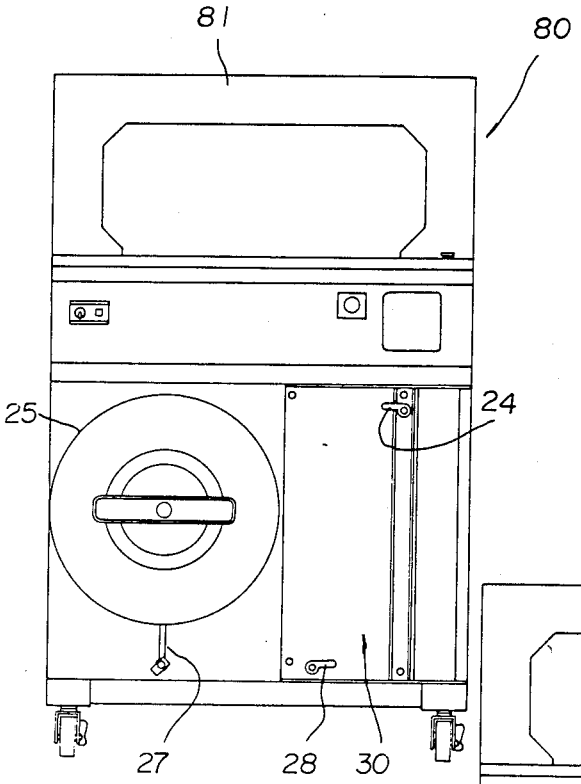
FIGS. 4(A) and 4(B), a general front view and a general rear view of a packaging machine in another type, respectively.
Figure 4B:
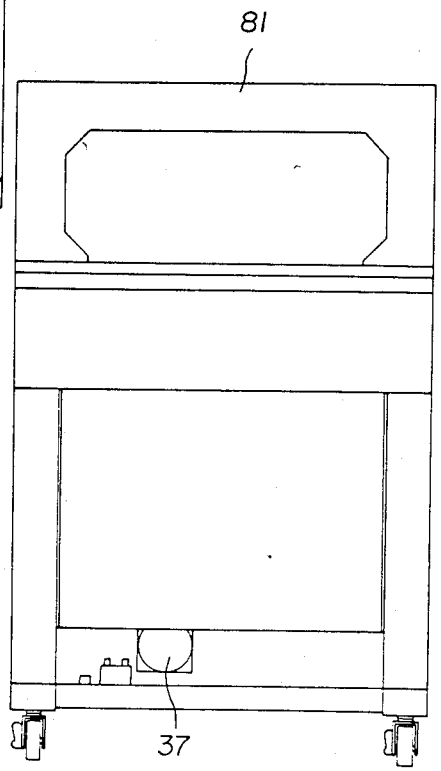

An embodiment of the present invention is described wherein said invention is applied to a packaging machine including a pool box with a short horizontal dimension, as illustrated in FIGS. 4(A) and 4(B).

Figure 1A:
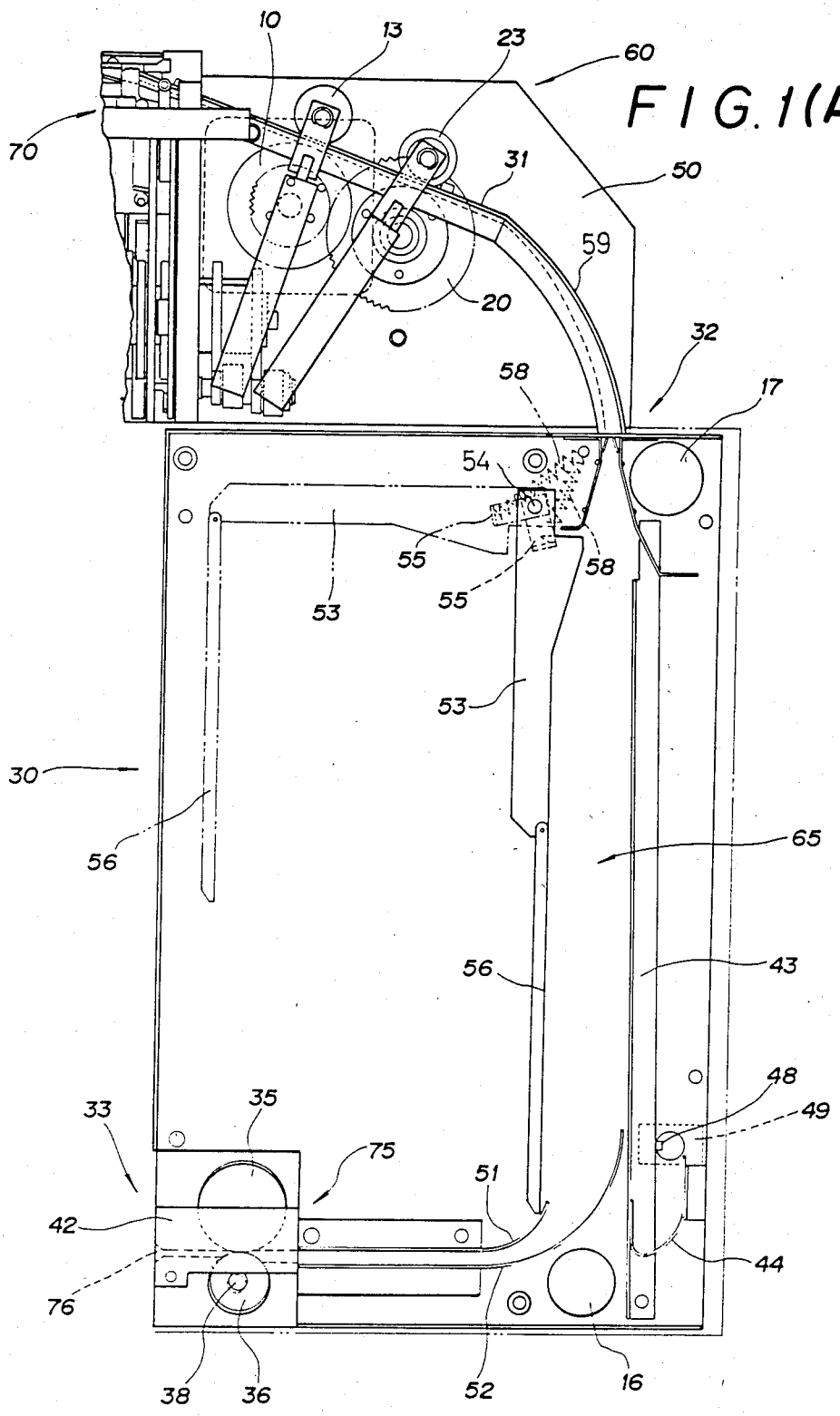
FIG. 1(A) is a vertical sectional view through a portion of a strapping machine in accordance with a first embodiment of the invention.
Figure 2A:
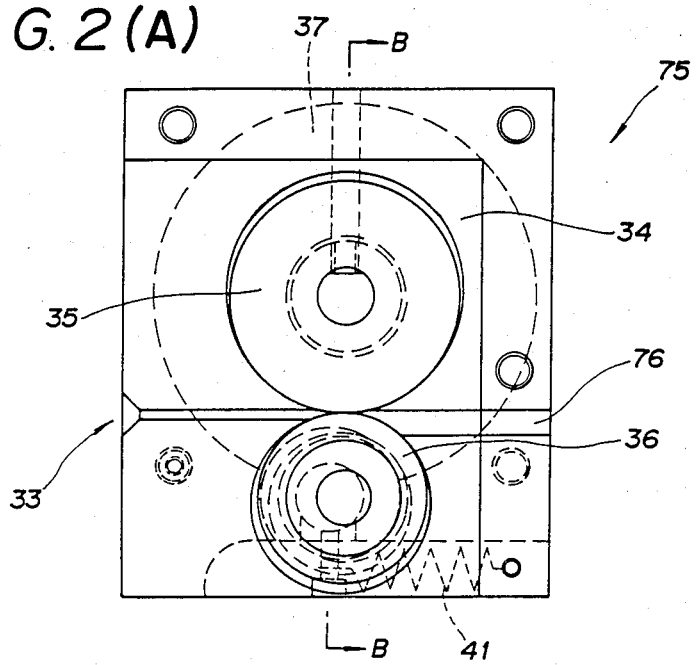
FIG. 2(A), a front view of the portion of the pool roller.
Figure 2B:
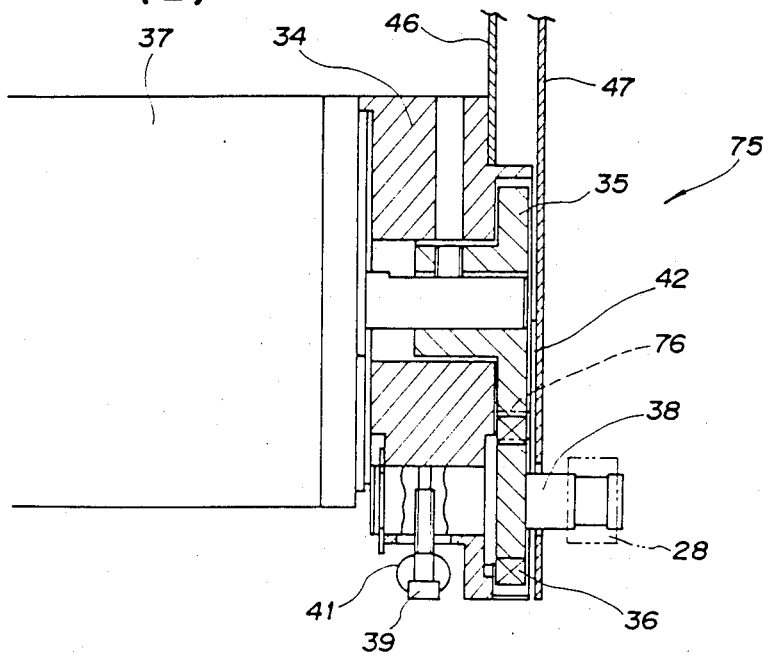
FIG. 2(B), a sectional view taken along a line B—B of FIG. 2(A)

Referring to FIGS. 1(A), 2(A) and 2(B), a pool box 30 is provided with an inner wall 46 and an outer wall 47 which are opposed in parallel with a band outlet 32 and a band inlet 33 at the top and the lower portion thereof, respectively. The band inlet 33 is provided with a pool roller 75. The pool roller 75 is composed of a pool feed roller 35 and a pool touch roller 36 which are rotatably supported in a bearing case 34 functioning also as a pool chute 76 defining a band passage. The pool feed roller 35 is directly attached to and driven by a pool motor 37, and the pool touch roller 36 is supported by an eccentric shaft 38 and is energized in the direction of the pool feed roller 35 by a spring 41 having an end thereof locked on a hook 39 attached to the eccentric shaft 38, thereby being brought into compressive contact with the circumferential surface of the pool touch roller 36. A chute cover 42 covers the slidable contact surface of the pool feed roller 35 with the pool touch roller 36.

The lower end of an L-shaped balance bar 43 is pivotably supported by the inner wall 46 of the pool box below the band outlet 32 in the vicinity of the bottom of the pool box 30. The bar is ordinarily biased by a plate spring 44 so that the upper end of the bar faces the band outlet 32. The inner wall 46 in the vicinity of the bottom of the pool box 30 is provided with an insertion hole 45, from which the lead piece 48 of a limit switch 49 mounted on the inside of the inner wall 46 is projected and is so situated as to contact the rear surface of the balance bar 43.

The inside of the pool box 30 is provided with guide plates 51 and 52 composed of plate pieces which define a band passage in communication with the band passage 76 of the bearing case 34 mounted on the band inlet 33. The guide plate 52 is extended to a position at which the end thereof, bent in the form of a quarter-arc, approaches the lower portion of the balance bar 43. The end of the other guide plate 51 slightly rises and terminates at a position lower than the end of the plate 52. The upper end of a guide bar 53, the length of which guide bar being approximately half the height of the pool box 30, is supported by a shaft 54 in the vicinity of the band outlet 32 of the pool box 30. The shaft 54 which is supported on the inner wall 46 is fixed to a crank 55, to which is connected one end of the spring 58 with another end thereof being attached to the wall 46 in the vicinity of the band outlet 32. The guide bar 53 can be swung between positions shown in solid and dotted lines in FIG. 1(A). The upper end of a swing arm 56 is pivotably supported at the lower end of the guide bar 53, and the lower end thereof abuts one end of the guide plate 51 situated at the upper portion of the guide plates 51 and 52.

The lower end of a guide chute 59 faces the band outlet 32 of the pool box 30 and the upper end thereof is connected to the rear end of a band chute 31. The chute 31 is brought into slidable contact with the inside of a pair of rollers 10 and 13 and another pair of rollers 20 and 23 which constitute a band-feeding and tightening mechanism 60.

Referring to FIG. 1(A) again, spacers 16 and 17 are arranged to ensure a space with a width greater than that of the band inside the pool box 30 when the outer wall 47 of the pool box 30 is mounted thereon. Referring to FIG. 4(A), an actuating handle 24 is secured to the shaft 54 on the guide bar 53 and another handle 28 is attached to the end of the eccentric shaft 38 of the pool touch roller 36. A band reel 25 is loaded with a band coil, and the band is fed to a band guide arch 81 on a main body 80 via a brake lever 27, the pool box 30, and the band-feeding and tightening mechanism 60.

The band-feeding and tightening mechanism 60 is disclosed in U.S. Pat. No. 4,383,881, and the main portion thereof is illustrated in FIG. 5 and FIG. 6. The mechanism is provided with a forward roller 10 constituting a pair of feed rollers which faces the band chute 31 and feeds a band toward the outside of the main body at a regular interval, and with a reverse roller 20 constituting a return roller for returning the band which is wound around goods to be packaged. A reduction motor 15 is directly connected to the drive shaft 11 of the forward roller 10, and a gear 19 attached to the drive shaft 11 is meshed with a gear 26 of greater diameter than that of the gear 19 connected to the shaft 21 of the reverse roller 20. Accordingly, the forward roller 10 and the reverse roller 20 always rotate in directions opposite to each other.

Numerals 13 and 23 denote forward and reverse touch rollers which are locker rollers and have a similar structure. The structure related to both touch rollers is described with reference to FIG. 6 showing the acting mechanism of the forward touch roller 13. Both of the touch rollers are supported by eccentric shafts 86 and 85, to the ends of which the upper ends of acting levers 90 and 95 are pivotably attached. The lower ends of these levers 90, 95 are loosely inserted into a hole 92 bored through the bent pieces of L-shaped interlocking levers 91 and 96 and are each biased by a spring 93. The lower end of the acting lever 90 is attached to the tips of arm levers 98 and 99 having rolls 94 and 97. One end of the arm levers 98 and 99 are pivotably supported by a shaft 100 projected on the base plate, and a spring 101 is locked at another end thereof to bias the lever 98, 99 in the direction of the band chute 31.

Cams 102 and 103 are mounted on a shaft which is the extension of a cam shaft 40 for actuating a band fusion mechanism 70 composed of a known band gripper, a heater and a center press, etc. are brought into contact with the rolls 94 and 97 of the arm levers 98 and 99, respectively, to perform an interlocking action with the interlocking levers 91 and 96, or the acting levers 90 and 95.

Figure 9:
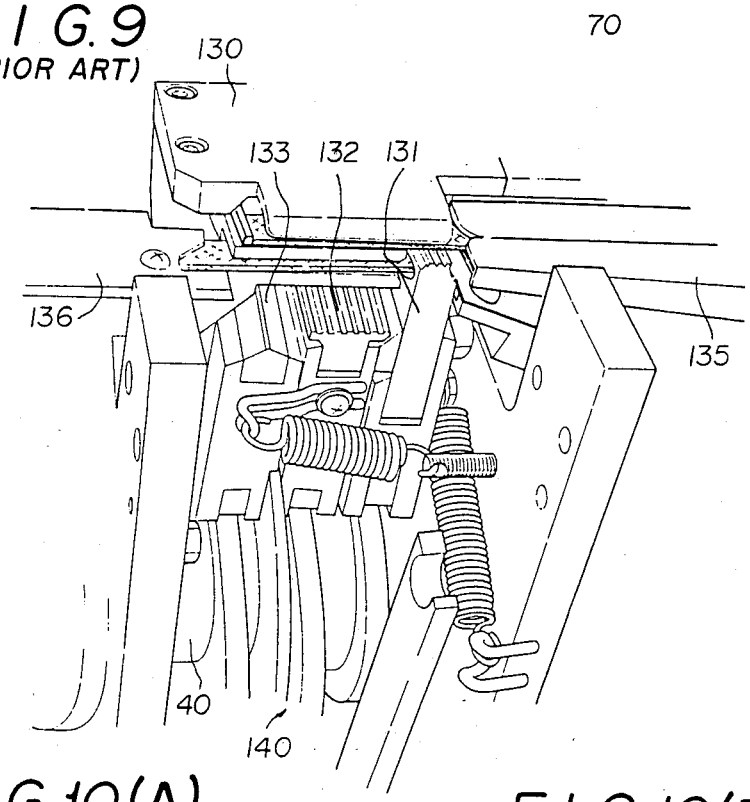
FIG. 9 (PRIOR ART)
FIG. 9, a perspective view of a band-fusing mechanism.
Figure 10A:
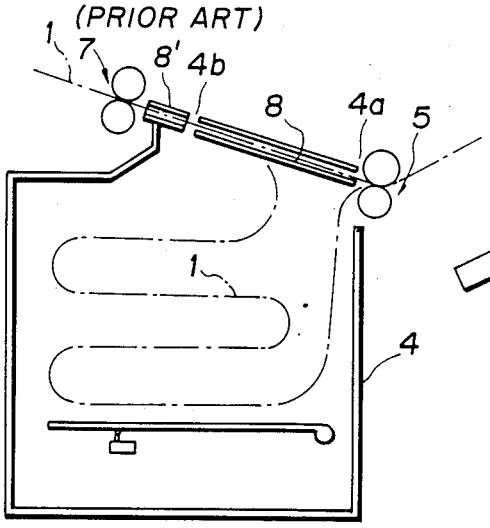
FIG. 10(A) (PRIOR ART)
Figure 10B:
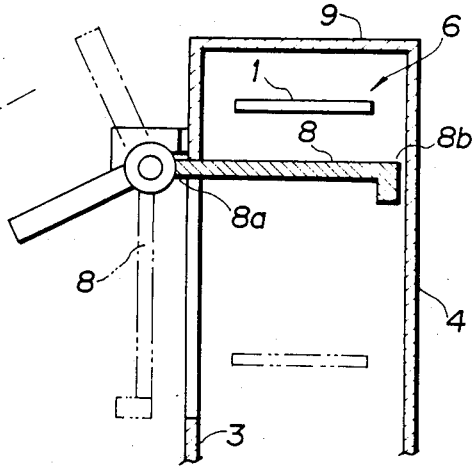
FIG. 10(B) (PRIOR ART)

The band fusion mechanism 70, as illustrated in FIG. 9, has a known structure including presses 131–133 which performs vertical movement by means of a plurality of cams 140 fixed on the cam shaft 40, a right press 131 is for gripping the loading end of the band, a left press 133 is for gripping and fixing the main portion of the band which is returned to cause the band to wind around the goods to be packaged, and a center press 132 which fuses and compressively seals overlapping portions of the band by means of a heater (not shown) when the overlapped portions are pressed between these presses 131–133 and a slide table 130. A right band way 135 and a left band way 136 are in communication with both of the lower ends of the band guide arch 81 on the main body.

In the embodiment illustrated herein, the forward touch roller 13 and the reverse touch roller 23 which are the locker rollers were used as follower rollers which rotate in slidable contact with the forward roller 10 and the reverse roller 20. The forward roller 10 and the forward touch roller 13 may be meshed with the reverse roller 20 and the reverse touch roller 23, respectively, by means of gears with the same diameters at high and low positions to effect forward and reverse rotations with each other.

In loading the band, the guide bar 53 and the swing arm 56 are arranged at positions illustrated by solid lines in FIG. 1(A) by means of the handle 24 attached to the shaft 54 of the guide bar 53. Then the band is removed by manually rotating the band reel 25 and the band inserted into the pinch rollers of the brake lever 27, and the eccentric shaft 38 of the pool touch roller 36 is pivotably rotated counterclockwise with regard to FIGS. 1(A), 2(A) and 4(A) opposing the spring 41 to admit the band from the pool chute 76 into a position between the pool feed roller 35 and the pool touch roller 36. Finally, the operator's hand is removed from the eccentric shaft 38 whereby preparation for loading the band is completed. Because an operation start switch on the front of the main body 80 of the packaging machine which is turned on causes the pool motor 37 to rotate, the band is removed from the band reel 25 at a position between the pool feed roller 35 and the pool touch roller 36 which is subjected to compressive contact by means of the pool feed roller 35 with the aid of the spring 41 to perform subordinate rotation. The removed band is transferred from the band outlet 32 to the inside of the guide chuter 59 via the passage defined between the guide plates 51 and 52, subsequently through the band guide passage 65 defined between the balance bar 43 and the guide bar 53 or the swing arm 56, and finally approaching the band chute 31.

When the operation start switch is turned on, the forward rotating roller 10, which is directly driven coupled to the reducer motor 15, and the cam shaft 40 directly coupled to a cam shaft motor (not shown) are caused to rotate. The convex portion of the cam 102 presses the roll 94, whereupon the forward touch roller 13 is brought into compressive contact with the forward roller 10 (refer to FIG. 6), and the band which approached the band chute 31 is transferred via the inside of the band guide arch 81 on the main body 80 by means of both rollers 10 and 13 to the band fusion mechanism 70. The compressive contact of the rollers 10 and 13 is relieved by the re-rotation of the cam shaft 40 which stopped during the setting period of the timer coupled to the cam shaft motor. Because the band is further fed for a very short period from the approach of the band end to the band fusion mechanism 70 prior to the relief of the compressive contact of the rollers 10 and 13, the resulting surplus band causes slack, exert adverse effects on the band guide arch 81, the band chute 31, and the balance bar 43, and the band guide passage 65 between the balance bar 43 and the guide bar 53 or the swing arm 56. Accordingly, the slack of the band will act against the plate spring 44 to push the balance bar 43 toward the right with regard to FIG. 1(A).

The rear surface of the balance bar 43 is provided with the lead piece 48 of the limit switch 49 projected from the insertion hole 45 bored into the inner wall 46 of the pool box 30. The movement of the lead piece in a direction identical to that of the balance bar 43 turns the limit switch 49 on, whereby the signal produced therefrom causes the pool motor 37 to stop. The slack of the band between the balance bar 43 and the guide bar 53 or the swing arm 56 not only causes the balance bar 43 to transfer but also causes the swing arm 56 attached to the lower end of the guide bar 53 to swing toward the left with regard to FIG. 1(A). For this reason, the stopping of the pool motor 37 which is delayed to some degree never causes problems such as a jam of the band on the band passage from the pool roller 75 via the band guide passage 65, the guide chute 59, the band chute 31 and the band guide arch 81 to the band fusion mechanism.

When the handle 24 mounted on the shaft 54 of the guide bar 53 is rotated clockwise with regard to FIG. 1(A) and the guide bar 53 is transferred in the direction of the dotted line in the drawing, the swing arm 56 becomes situated at the left end of the pool box 30 to render the pool box 30 in the standby state of the band pool. Accordingly, the band which slacked between the balance bar 43 and the guide bar 53 or the swing arm 56 transfers to the inside of the pool box 30, so that the lead piece 48 returns to the original position thereby turning the limit switch 49 off. The signal causes the pool motor 37 to rotate again and the pool roller 75 composed of the pool touch roller 36 which is always biased toward the pool feed roller 35 pools the band inside the pool box 30. After, is driven a predetermined amount of band is pooled pivotably rotates the balance bar 43 to the right with regard to FIG. 1(A) because of the compressive force of the band, so that the lead piece 48 is shifted again to stop the pool motor 37.

Loading and pooling of the band is completed in this way, thus finishing the preparation for packaging.

The mechanism consisting of the forward roller 10 and the forward touch roller 13 for feeding and tightening the band has a clearance with a thickness exceeding that of at least one thickness of the band when the convex portion of the cam 102 is not pressing the roll 94. Accordingly, the mechanism exerts no adverse effect on the band in the band chute 31. The relation between the reverse roller 20 and the reverse touch roller 23 is also the same as the above.

By operating the starting switch, the cam shaft 40 begins to rotate, and the band end-gripping mechanism of the band fusion mechanism grips the end of the band. Because the cam is also rotating simultaneously, the acting lever 95 is pressed through the intermediary of the roll 97, the arm lever 99, and the interlocking lever 96. The eccentric shaft is caused to pivotably rotate in the form of an arc to press the reverse touch roller 23 supported by the eccentric shaft downward toward the reverse roller 20. For this reason, the portion of the band in the band chute 31 is pulled back at high speed and tightened by the reverse roller 20 and the reverse touch roller 23.

When the band is strongly wound around goods to be packaged after the lapse of the preset time, the cam shaft rotates again to grip the band main portion via the press 133, and the arm lever 99 is caused to swing in a manner relieving the compressive contact of the reverse touch roller 23 with the reverse roller 20 to form a clearance therebetween sufficient to produce the absence of contact with the band. The cam shaft 40 which continues rotating activates a sealing of the overlapping band portions and a cutting of the band main portion by means of the band fusion mechanism.

Because the rotation of the cam shaft 40 rotates the cam, the forward roller 10 and the forward touch roller 13 achieve the state shown in FIG. 6, the band is subjected to compressive contact between both rollers whereby a predetermined amount of the band is fed to the upper surface of the main body.

The timer or other control means causes the cam shaft 40 to rotate again, thereby rotating the eccentric shaft 86 with the aid of the acting lever 90, whereby the compressive contact of the forward touch roller 13 with the forward roller 10 is relieved to complete the band feeding process by means of the rotation of the cam 102.

When the amount of the band pooled in the pool box 30 is decreased due to feeding of the band, the balance bar 43 is transferred to the left, with regard to FIG. 1(A), in the pool box 30 to turn the limit switch 49 on. The rotation of the pool motor 37 removes a definite amount of the band from the band reel to pool the band in the pool box 30 again. When the band pooled therein reaches a predetermined amount, the lead piece 48 is pushed by the rear surface of the balance bar 43 to stop the pool motor 37 by means of the signal of the limit switch. The same action is repeated thereafter.

Figure 1B:
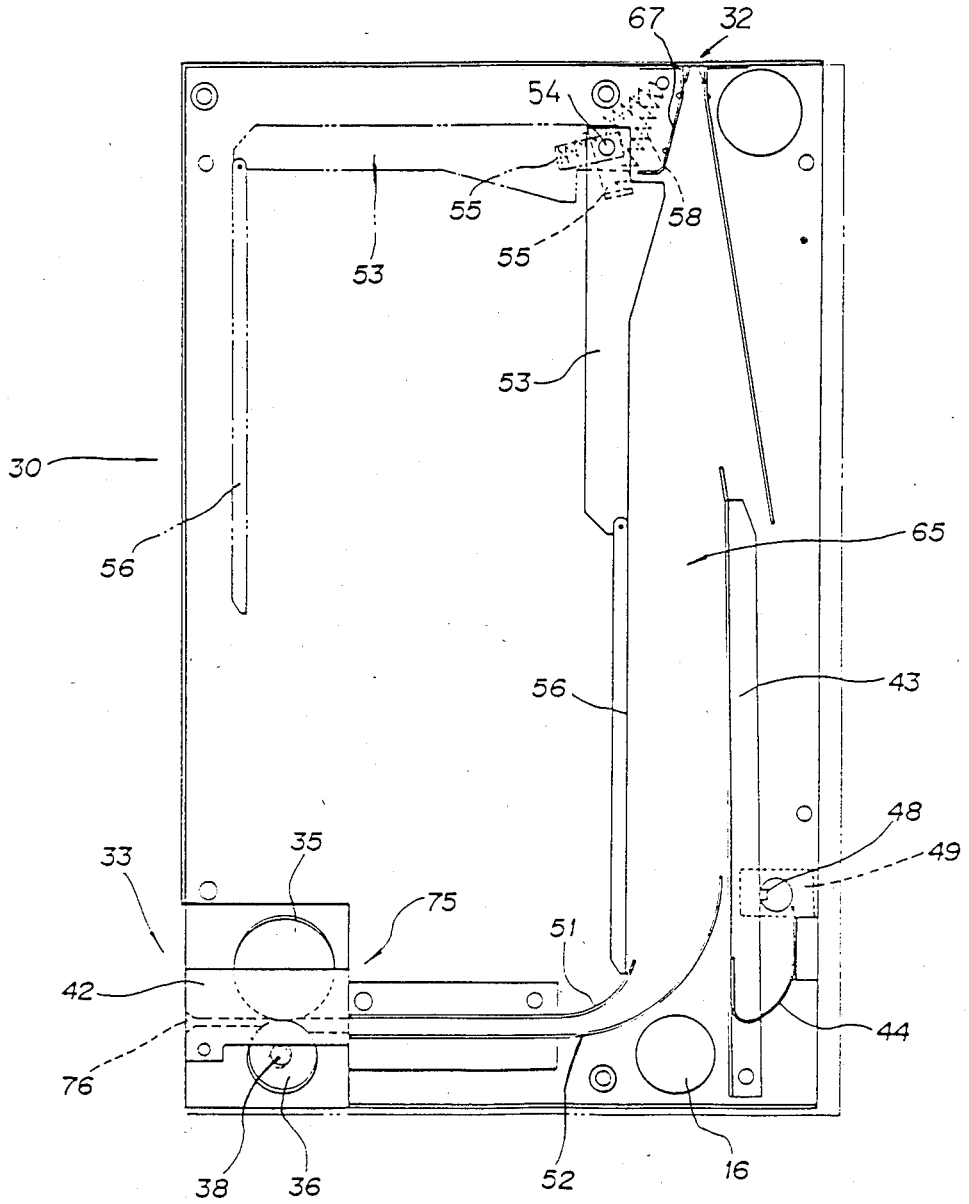
FIG. 1(B) is a vertical sectional view through a portion of a pooling box in accordance with a second embodiment of the invention.

FIG. 1(B) shows a second Embodiment of the present invention, wherein the balance bar 43 is somewhat shorter than that in the first Embodiment, and the upper end thereof is opposed to the guide bar 53 at a position somewhat closer to the band outlet and somewhat higher than the lower end of the guide bar 53 with the upper end of the balance bar 43 being slanted to some degree toward the guide bar 53. A piece 67 a funnel-like guide body extended from the lower part of the band outlet 32 is disposed to prevent the band from dropping on the rear of the balance bar 43 when the band is pulled back from the reverse roller 20, and the reverse touch roller 23 and the piece 67 are not essential for band loading and the band pool. The structure and action are the same as those of the first Embodiment in other respects.

Figure 3:
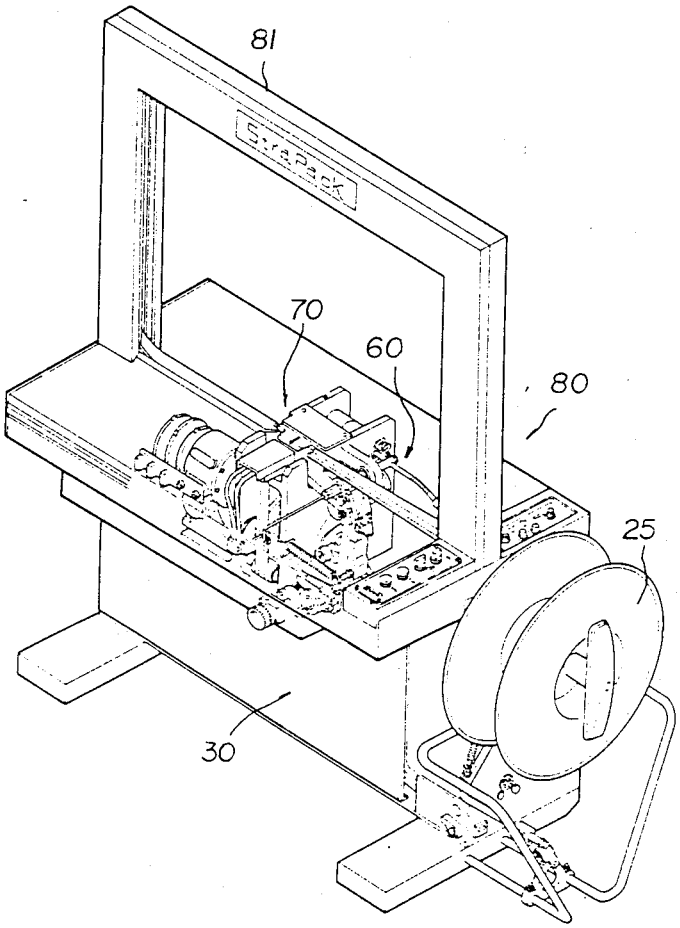
FIG. 3, the whole of the packaging machine, a perspective view in perspective of a mechanism for feeding and tightening the band and a fusing mechanism of the band-joining portion.
Figure 7:
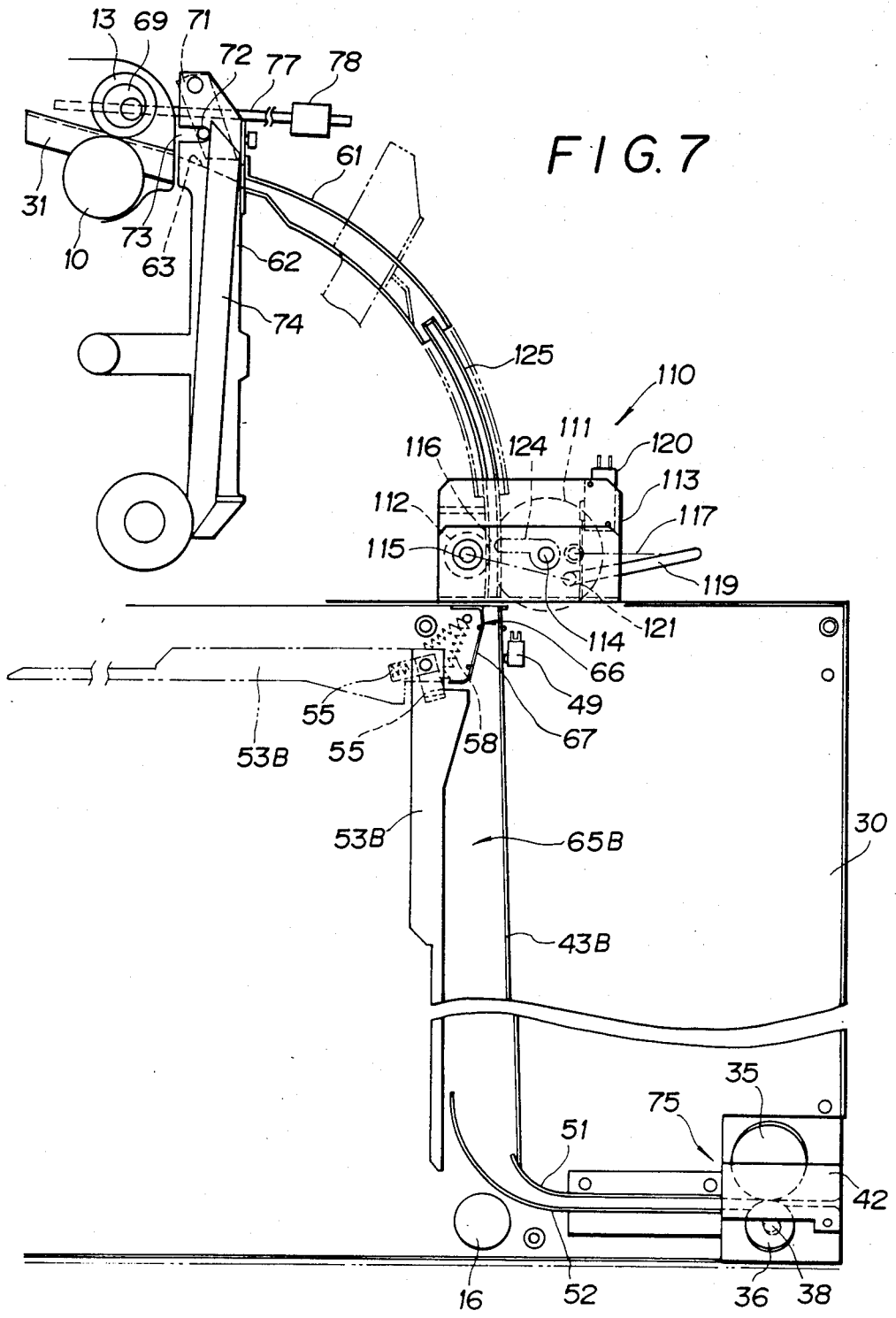
Figure 8A:
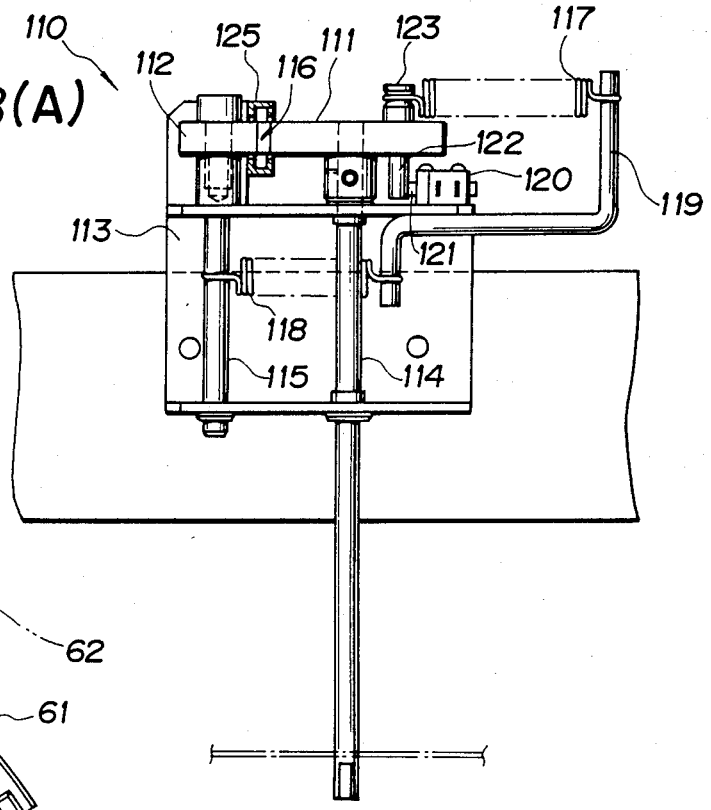
FIGS. 8(A) and 8(B) are both the front views thereof.
Figure 8B:
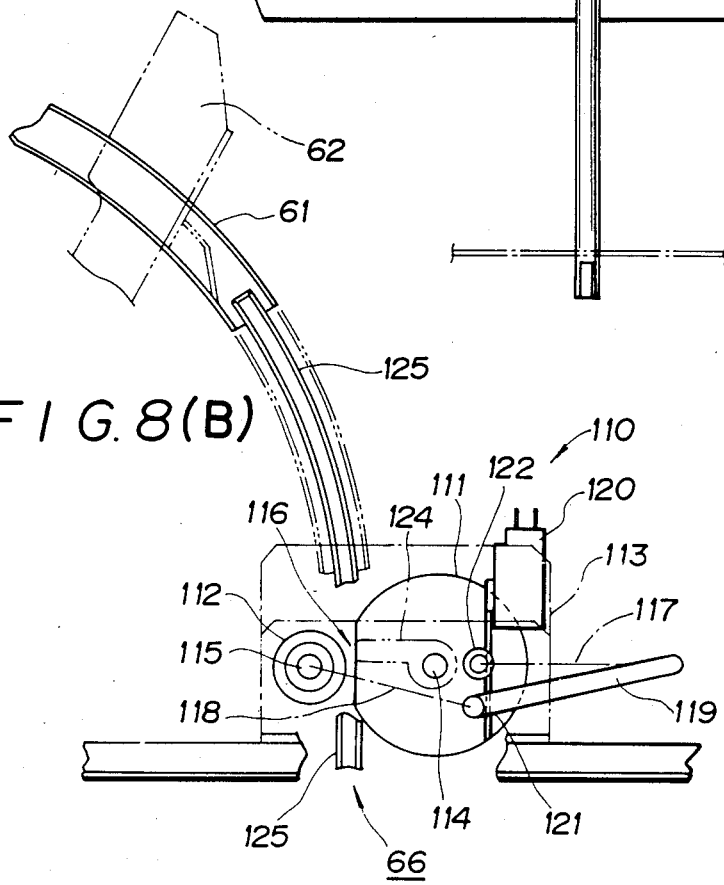

FIGS. 7, 8(A) and 8(B) illustrate still another embodiment of the present invention. The embodiment relates to application of the present invention to a packaging machine including a pool box of a relatively large horizontal length, as shown in FIG. 3, and more particularly, relates to a preferably band packaging apparatus especially when a tension-free, soft and narrow band is used.

Differences from the above-mentioned embodiments are described below.

A balance bar 43B is opposed to the piece 67 facing the band outlet to form a guide passage. The upper end of the balance bar 43B is pivotably supported to be capable of freely swinging, whereas the lower end thereof contacts the outside of the end of the guide plate 51 of the pool roller 75 by means of its own weight. The guide bar 53B is integrally formed with no swing arm 56 provided therein, and the free end thereof contacts the outside of the end of the guide plate 52 whereby the balance bar 43B and the guide bar 53B define a band guide passage 65B.

A band set unit 110 is disposed on a back pool formed in the right space of the pool box 30 and is entirely circular with a wide, rectangular cross-section composed of (a) a guide chute 125 onto which a channel for allowing the band to pass is formed, (b) a pre-feed roller 111 and (c) a traveling roller 112 which rollers are opposed to each other in a cut-out formed in the guide chute 125.

One end of the guide chute 125 is directed to the piece 67 via the band outlet 66 and to the band guide passage 65B between the guide bar 53B and the balance bar 43B; the other end thereof is disposed so as to be situated in a tension arm chuter 61 to be described later.

The pre-feed roller 111 and the traveling roller 112 are pivotably supported by the respective shafts 114 and 115 on the outside of an upward-directing U-like bracket 113 fixed on the back pool. The pre-feed roller 111 has a diameter larger than that of the traveling roller 112. A portion of the circumference of the roller 111 is formed with a notch 116, and two projections 122 and 123 are arranged on both sides thereof at a position opposite to the notch 116 with regard to the shaft 114. One projection 122 on the side of the bracket 113 is arranged movable away from the lead piece 121 of a limit switch 120 mounted on the outer wall of the bracket 113. One end of a spring 117 to be described later is attached to the other projection 123 on the side opposite to the projection 122.

The limit switch 120 detects the movement of the projection 122 away from the lead piece 121 to produce a signal, whereby the motor of a forward roller 10 to be described later is turned on to cause forward rotation of the forward roller 10 for a preset time by means of a timer.

A spring hook 119 which is bent in two portions is welded at the center of one on the opposing walls in the bracket 113. One bent end of the spring hook 119 is projected adjacent the pre-feed roller 111 on the outside of one side wall of the bracket 113. The spring 117 is loaded between the bent end and the projection 123 provided on the side of the pre-feed roller 111, which is thus energized to a rest position such that the notch 116 is ordinarily situated opposite the circumference of the traveling roller 112. In addition, the pre-feed roller 111 is arranged so as to provide a clearance for allowing the band to pass between the outer notch and the circumference of the traveling roller 112 and to bring the outer circumference of the pre-feed roller 111 except for that of the notch thereof into slidable contact with the outer circumference of the traveling roller 112 through the intermediary of the band. Another bent end of the spring hook 119 is situated in the bracket 113 and a spring 118 is loaded between that end and the shaft 114 of the traveling roller 112, whereby the traveling roller 112 is always energized in the direction such that slidable contact with the pre-feed roller 111 is performed. In such a way, a certain degree of play is formed between the shaft 114 and the hole of bracket 113 in which the shaft is mounted, whereby the outer circumference of the pre-feed roller 111 is accurately brought into slidable contact with the traveling roller 112 according to various bands of different thicknesses.

The shaft 114 of the pre-feed roller 111 is extended forward with regard to FIG. 7 with the end thereof being situated on the outside of the cover of the main body 40 to receive a lever 124.

A numeral 62 denotes a known tension arm, in which the lower end is shaft-supported enabling it to swing freely, and a band guide channel 63 is bored on the upper portion. A jaw 71 is shaft-supported at the upper end of the tension arm 62, and the lower surface of the jaw 71 is directed to the band guide channel 63. The jaw 71 is energized by a spring (not shown) in a direction ordinarily away from the bottom of the guide channel 63. A pin 72 which is inserted into the lower portion of the jaw 71 is situated in a notch 73 formed in the upper portion of the arm 62. The pin 72 abuts against the upper end of an adjusting arm 74 with the lower end thereof being shaft-supported. Another spring having energizing force greater than that of the spring of the jaw 71 is linked to the adjusting arm 74. When the tension arm 62 swings clockwise with regard to FIG. 7 by means of a cam (not shown), the energizing force of the other spring which pulls the adjusting arm 74 to the left with regard to FIG. 7 overcomes that of the spring of the jaw 71, whereby the jaw 71 is brought into compressive contact with the bottom of the guide channel 63 through the intermediary of the adjusting arm 74, so that the band is gripped between the lower surface of the jaw 71 and the bottom of the band guide channel 63, and the band of a definite degree of stroke is thus tightened.

One end of a circular tension arm chute 61 having a curvature the same as that of the guide chute 125 is attached to the inlet of the band guide channel 63 of the tension arm. The tension arm chute 61 has a wide, rectangular cross-section including therein a channel for allowing the band to pass. Accordingly, the tension arm chute 61 has a thickness sufficient to insert thereinto the guide chute 125, the end of which is always situated in the tension arm chute 125.

A feed chute 31 having a channel for allowing the band to pass is provided facing the outlet of the band guide channel 63 of the tension arm 62. A feed roller or a forward roller 10 to be driven and an upper roller 13 which rotates subordinate to the feed roller are also provided facing the outlet of the band guide channel 63. Both rollers are opposed to each other in a cut-out formed in the feed chute 31. The forward roller 10, which is connected to a motor (not shown), performs forward rotation for a period set by a timer by means of a signal indicating the completion of the fusion of a band-joining portion as the final process of one cycle of the packaging operation. In such a way, the band is fed into the band guide arch, and a signal from the limit switch 120 of the band set unit 110, viz., a signal indicating the clockwise rotation, with regard to FIG. 7, of the pre-feed roller 111 causes the timer to rotate forward for a predetermined period to feed the band into the band guide arch. The band is pulled back by the reverse rotation of the timer for a predetermined period thereof because of the starting button which was turned on after the gripping of the end of the band by means of a band-gripping mechanism.

Referring to FIG. 7, the forward touch roller 13 is supported by an eccentric shaft 69 and a weight 78 is transferably mounted on an adjusting lever 77 inserted into the eccentric shaft 76. The eccentric shaft 76 is always subjected to downward energization with respect to FIG. 7 by means of the weight 78, whereby the forward touch roller 13 is brought into slidable contact with the forward touch roller 13 with a definite amount of force, and the transfer of the adjusting lever causes both rollers to separate from each other. The transfer and adjustment of the weight on the adjusting lever builds up a freely changeable force by which the forward touch roller 13 is brought into slidable contact with the forward touch roller 13.

The band directly inserted into the guide chuter 125 from the band coil 25 via the pool roller 75, as with the case of the preceding embodiments, through the intermediary of the band-guide passage 65B in the pool box 30 or manually is introduced between the notch 116 of the pre-feed roller 111 and the traveling roller 112. When the lever 124 is caused to pivotably rotate for an adequate number of times clockwise with regard to FIG. 1, the pre-feed roller 111 is caused to rotate, thereby bringing the un-notched peripheral portion of the pre-feed roller 111 into slidable contact with the traveling roller 112 through the intermediary of the band because of the transfer of the position of the notch 116 in the guide chute 125, and the gripped band is fed to a position in the vicinity of the forward roller 10 and the forward touch roller 13, or a position at which the band is brought into contact with both rollers, via the guide chuter 125, the tension arm chuter 61 and the band guide channel 63 of the tension arm 62. The pre-feed roller 111 is secured to a position at which the notch 116 is opposed to the circumferential surface of the travelling roller 112 per each pivotal rotation of the lever 124.

When the lever 124 is pivotably rotated again, the rotation of the pre-feed roller 111 separates a projection 22 mounted on the side of the pre-feed roller 111 from the lead piece 121 of the limit switch 120, so that a signal is produced from the limit switch 120 to turn the motor of the forward roller 10, whereby the end of the band in the vicinity of the forward roller 10 and the forward touch roller or that a position which contacts both rollers is gripped by the slidably rotating forward roller 10 and the forward touch roller 13, both rollers are caused to rotate forward for the preset period of the timer, the band is fed into the band guide arch and runs around the arch, and the end thereof approaches the band end-gripping mechanism. When the end of the band is situated in the vicinity of the pre-feed roller 111, band feeding by one rotation of the pre-feed roller 111 sometimes cannot cause the end of the band to approach the gripping mechanism. In such a case, the band is fed by the repeated pivotal rotation of the lever 124.

Because a certain amount of the band has been fed into the band guide arch in this case, the forward roller 10 is rotated forward again for a preset period due to the signal of the limit switch 120, so that an excess amount of the band can be further fed irrespective of the fact that the end of the band has approached the gripping mechanism. However, the pressure of the slidable contact of the forward touch roller 42 with the forward roller 10 is so controlled that the upper roller 78 may slip against the band under such a condition because of the transfer of the weight 78. There is no possibility that a surplus amount of the band fed into the band guide arch could run out therefrom, because the forward touch roller 13 slips on the surface of the band and does not follow the rotation of the forward roller 10 for the above reason. It is also preferable that a signal detecting the arrival of the band end in the gripping mechanism cause the rotation of the forward roller 10 to stop. The rotation control means of the forward roller 10 can use various known means.

The forward rotation of the forward roller 10 feeds the band into the band guide arch and turning the starting button on grips and secures the end of the band by means of the gripping mechanism. The subsequent actuation of the timer causes the reverse rotation of the forward roller 10 for a predetermined period. The band gripped between the forward roller 10 and the forward touch roller 13 is returned from the band guide arch and binds around the goods to be packaged.

When the tension arm 62 swings clockwise with regard to FIG. 1 because of a cam (not shown), the energizing force of the spring of the adjusting arm 74 overcomes that of the spring of the jaw 71, the adjusting arm 74 brings the jaw 71 into compressive contact with the bottom of the band guide channel 63 to grip and tighten the band between the lower surface of the jaw 71 and the bottom of the band guide channel 63 (refer to the two-dotted line), then the tension arm 62 relieves the grip of the band because of the jaw 71 and is returned after gripping and cutting of the band-feeding portion and sealing of the band-joining portion, and each mechanism is simultaneously returned to the respective original positions to feed the band into the band guide arch again. Although only the end of the pre-feed chuter 125 is inserted into the tension arm chuter 61 attached to the tension arm 62 (solid line in FIG. 7), the swing of the tension arm 62 in tightening the band inserts about half the entire length of the guide chuter 125 into the tension arm chuter 61 (two-dotted line in FIG. 7). The feeding portion of the band tightened by the tension arm 62 is pooled in the back pool. In this case, the notch 116 of the pre-feed roller 111 is restrained, at a rest position opposing the traveling roller 112, by the spring 117 to provide a clearance for allowing the band to pass between the outer circumference of the traveling roller 112 and the outer surface of the notch 116. Accordingly, the band is never locked at the portion and is smoothly fed to the back pool by means of the swing of the tension arm 62, such that the relief of band gripping because of the jaw 71 when it is returned, and the tightened band leaves in the back pool.

When an insufficient amount of the band fed to the band guide arch or clogging of the band in the arch causes failure of gripping at the end thereof, the return of the band because of the reverse rotation of the forward roller 10 and the forward touch roller 13 may cause the running-off of the band end from the band guide channel 63 between both rollers 10 and 13 or from the tension arm 62. Even in this case, the reverse rotation is controlled within the preset time of the timer. In addition, the band is usually left in the guide chute 125 because the band end is upwardly energized by the elasticity of the band due to a predetermined amount of the band pooled in the back pool and the pool box even if the reverse rotation is continued because of inertia after completion of the reverse rotation. Accordingly, in this case, rotation of the pre-feed roller 111 of the band set unit 110 by means of operation of the lever 124 from the outside of the main body 80 can feed the band to a position between the forward roller 10 and the forward touch roller 13 which constitute a pair of feed rollers. In addition, the signal of the limit switch 120 for detecting the rotation of the pre-feed roller can perform the forward rotation of the feed roller 41 for a preset time of the timer, thereby feeding the band into the band guide arch. If the end of the band falls into the back pool, the band can easily be reset merely by inserting the end thereof into the guide chuter 125 and subsequently rotating the lever 24. As is obvious from the above description, the band set unit 110 can be used independently of or selectively from the band guide passage 65 formed of the guide bar 53 from the pool roller 75 to the band outlet 32 (66) and the balance bar 43.

What is claimed is:

1. In a strapping machine for applying a band around an object, comprising a pool box for storing a section of band, said pool box having a band outlet, a pair of motor-driven feed rollers for feeding the band from the pool box, and guide chute means defining a guide path extending between the band outlet and said feed rollers for guiding said band, the improvement comprising band-loading means for pre-feeding the band from said pool box to said motor-driven feed rollers, said band-loading means comprising:

a pre-feeding roller pair including:

a traveling roller disposed on one side of said guide path adjacent said band outlet, and a rotatable pre-feed roller disposed opposite said traveling roller on an opposite side of said guide path, said pre-feed roller including a circular periphery interrupted by a notch, said circular periphery being operable to press a band against said traveling roller when said circular periphery is situated opposite said traveling roller, said notch forming a clearance with said traveling roller to permit a band to move freely therepast when said notch is situated opposite said traveling roller, said pre-feed roller being yieldably biased to a rest position wherein said notch is situated opposite said traveling roller, means for rotating said pre-feeding roller pair to pre-feed a band from said pool box to said motor-driven feed rollers as said circular periphery passes opposite said traveling roller, and sensing means for sensing rotation of said pre-feeding roller pair and energizing said motor-driven feed rollers for a predetermined time period in response to sensing rotation of said pre-feeding roller pair.

2. Apparatus according to claim 1, wherein said means for rotating said pre-feeding roller pair comprises a manually actuable handle connected to said pre-feed roller.

3. Apparatus according to claim 1 including spring means for yieldably biasing said pre-feed roller to said rest position.

4. Apparatus according to claim 1 including a projection extending from a side of said pre-feed roller at a location spaced from an axis of rotation thereof, said sensing means comprising a switch mounted so as to be located adjacent said projection when said pre-feed roller is in said rest position and being actuable in response to said projection moving away from said switch.

5. Apparatus according to claim 1, wherein said traveling roller is displaceable away from said pre-feed roller, and spring means for yieldably resisting such displacement of said traveling roller.

6. Apparatus according to claim 1, wherein said means for rotating said pre-feeding roller pair comprises a manually actuable handle connected to said pre-feed roller, first spring means arranged for yieldably biasing said pre-feed roller to said rest position, said traveling roller being displaceable away from said pre-feed roller, and second spring means for yieldably resisting such displacement of said traveling roller.

* * * * *